US007506574B2

(12) United States Patent
Jensen et al.

(10) Patent No.: US 7,506,574 B2
(45) Date of Patent: Mar. 24, 2009

(54) SELF-TIGHTENING COVER FOR PUMP

(75) Inventors: Ernest J. Jensen, Tulsa, OK (US); Anthony W. McLain, Broken Arrow, OK (US)

(73) Assignee: Gardner Denver, Inc., Quincy, IL (US)

( * ) Notice: Subject to any disclaimer, the term of this patent is extended or adjusted under 35 U.S.C. 154(b) by 938 days.

(21) Appl. No.: 10/798,651

(22) Filed: Mar. 11, 2004

(65) Prior Publication Data

US 2005/0201881 A1 Sep. 15, 2005

(51) Int. Cl.

| | |
|---|---|
| ***F01B 11/02*** | (2006.01) |
| ***F16J 10/00*** | (2006.01) |
| ***F04B 39/00*** | (2006.01) |
| ***F04B 11/00*** | (2006.01) |

(52) U.S. Cl. ..... 92/171.1; 417/454; 417/539

(58) Field of Classification Search ..... 417/454, 417/539, 568; 92/171.1

See application file for complete search history.

(56) References Cited

U.S. PATENT DOCUMENTS

| | | | | | |
|---|---|---|---|---|---|
| 2,766,701 | A | | 10/1956 | Giraudeau | |
| 3,037,460 | A | * | 6/1962 | Guest et al. | 92/171.1 |
| 3,137,216 | A | * | 6/1964 | Aytes | 92/171.1 |
| 3,277,837 | A | * | 10/1966 | Pangburn | 92/171.1 |
| 3,327,643 | A | * | 6/1967 | Pangburn | 92/171.1 |
| 3,372,648 | A | | 3/1968 | Hammelmann | |
| 3,373,695 | A | | 3/1968 | Yohpe | |
| 3,610,110 | A | | 10/1971 | Schaaf | |
| 3,666,382 | A | | 5/1972 | Rasmussen | |
| 3,792,393 | A | * | 2/1974 | Streich et al. | 335/273 |
| 4,264,286 | A | | 4/1981 | Reinkemeyer | |
| 4,477,236 | A | | 10/1984 | Elliott | |
| 4,508,133 | A | * | 4/1985 | Hamid | 137/68.22 |
| 4,520,837 | A | | 6/1985 | Cole et al. | |
| 4,771,801 | A | | 9/1988 | Crump et al. | |
| 4,927,305 | A | | 5/1990 | Peterson, Jr. | |
| 5,073,096 | A | | 12/1991 | King et al. | |
| 5,382,057 | A | | 1/1995 | Richter | |
| 5,839,888 | A | | 11/1998 | Harrison | |
| 6,419,459 | B1 | | 7/2002 | Sibbing | |

* cited by examiner

*Primary Examiner*—Charles G Freay
*Assistant Examiner*—Peter J Bertheaud
(74) *Attorney, Agent, or Firm*—James B. Conte

(57) ABSTRACT

A self-tightening retaining system for securing a closure in position closing an access port of a pump housing. The system includes a retaining cover for obstructing removal of the closure from a bore of the access port. The cover has external threads interengageable with screw threads of the bore. A locking device is configured for being secured to the cover such that the locking device rotates together with the cover. The locking device has a fastener receivable in a hole of the closure and has external threads interengageable with threads of the hole. The threads of the cover and the threads of the fastener are spiraled in opposite directions such that when the cover rotates in a loosening direction, the fastener becomes tightened in the hole of the closure thereby stopping the rotation.

15 Claims, 5 Drawing Sheets

SELF-TIGHTENING COVER FOR PUMP

BACKGROUND OF THE INVENTION

This invention relates generally to pumps, and in particular to a self-tightening retaining system for holding a cover in position closing an access port of a pump housing.

High pressure pumps are widely used in the petroleum industry for a variety of field operations relating to oil and gas wells. Such pumps deliver a fluid or slurry, which may carry solid particles (e.g., a sand proppant), at pressures up to 20,000 psi. A common type is a positive displacement pump having one or more plungers reciprocally movable in a corresponding pump chamber. Each chamber has an intake port for receiving fluid, a discharge port for exhaust, and a one-way flow valve in each port for preventing reverse flow. These valves require frequent maintenance. Components of the valves are formed of a material which forms an effective seal, such as polyurethane, but which is incapable of withstanding the erosive environment of the pump chamber for an extended duration. Typically, each valve must be serviced after every period of continuous operation at a well site (e.g., every four to six hours) for replacement of worn components. An access port is provided in a wall of the pump housing, at a location near the valves, so that maintenance personnel can readily reach the valves.

The access port must be securely closed and sealed for proper operation of the pump. A closure device, such as a plug with a circumferential seal, is provided for installation in the access port. A retaining cover is typically secured in the access port behind the closure to firmly hold the closure at its installed position. The retaining cover has external threads and is rotatably received in a threaded portion of the access port. Typically, a worker tightens the retaining cover in the access port to a high torque using a sledge hammer and a tool placed in a cavity of the cover to effect its rotation.

Unfortunately, the retaining cover is subject to inadvertently loosen. The pump experiences substantial vibration during operation at high power settings such that the retaining cover can overcome its initially applied torque and begin to "back out", or rotate in the access port in a loosening direction. Should the retaining cover continue to loosen, the closure and a quantity of high pressure fluid would be ejected from the pump housing and potentially cause damage or injury. Consequently, safety regulations demand that operators respond to any loosening of the retaining cover by stopping the pump. That degrades efficiency and can necessitate the expense of a back-up pump for continuing a pumping operation while the primary pump is shut down.

SUMMARY OF THE INVENTION

Among the several objects and features of the present invention may be noted the provision of a retaining system for securing a closure within a bore of a pump housing; the provision of such a system which enhances safety; the provision of such a system which self-tightens; the provision of such a system which is compatible with existing pump equipment; the provision of such a system which is reliable; and the provision of such a system which is economical.

In general, a self-tightening retaining system of the invention is for securing a closure at an installed position within a bore of a housing to close the bore. The bore has screw threads along at least a portion of the bore and the closure has an internally threaded hole extending into the closure. The system comprises a retaining cover for obstructing removal of the closure from the bore. The cover is receivable in the bore in a position generally adjacent the closure and has external threads interengageable with the screw threads of the bore such that the cover is rotatable relative to the housing in a tightening direction for movement of the cover into the bore toward the closure and rotatable in an opposite, loosening direction for movement of the cover out from the bore away from the closure. The cover has a central axis of rotation. A locking device is configured for being secured to the cover such that the locking device rotates together with the cover about the central axis. The locking device comprises a fastener receivable in the hole of the closure and having external threads interengageable with threads of the hole. The threads of the cover and the threads of the fastener are spiraled in opposite directions such that when the cover rotates in the loosening direction, the fastener becomes tightened in the hole of the closure thereby stopping the rotation.

In another aspect, a method according to the invention locks a closure at a sealing position within a bore of a pump housing. The method comprises the steps of installing a retaining cover in the bore adjacent the closure, the cover having screw threads interengageable with screw threads of the bore such that the cover is rotatable relative to the housing in a tightening direction and an opposite, loosening direction. The cover has a central axis of rotation, the step of installing comprising rotating the cover about the axis in the tightening direction. A locking device is secured to the cover such that the locking device rotates together with the cover about the central axis. A fastener is threaded into a threaded hole in the closure to secure the fastener to the closure. The fastener and hole of the closure have screw threads spiraled in opposite direction to the screw threads of the cover and bore such that when the cover rotates in the loosening direction, the fastener becomes tightened in the hole of the closure thereby stopping the rotation.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 2:
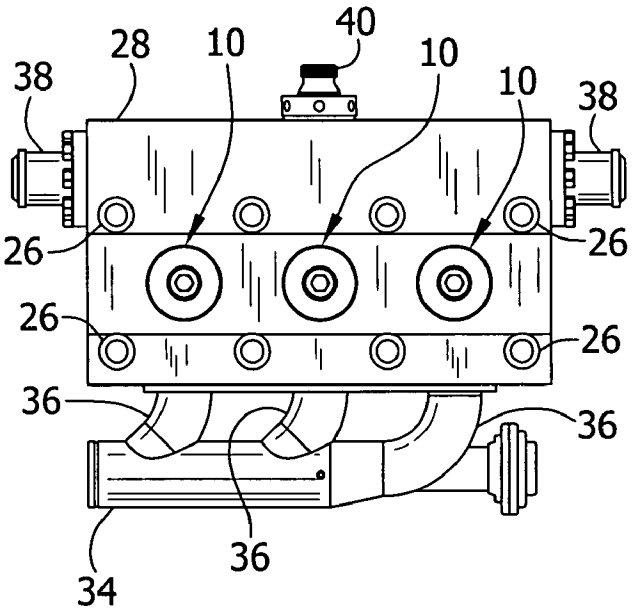
FIGS. 1 and 2 are side and front elevations, respectively, of a high pressure pump having a cover retaining system according to one embodiment of the present invention.
Figure 1:
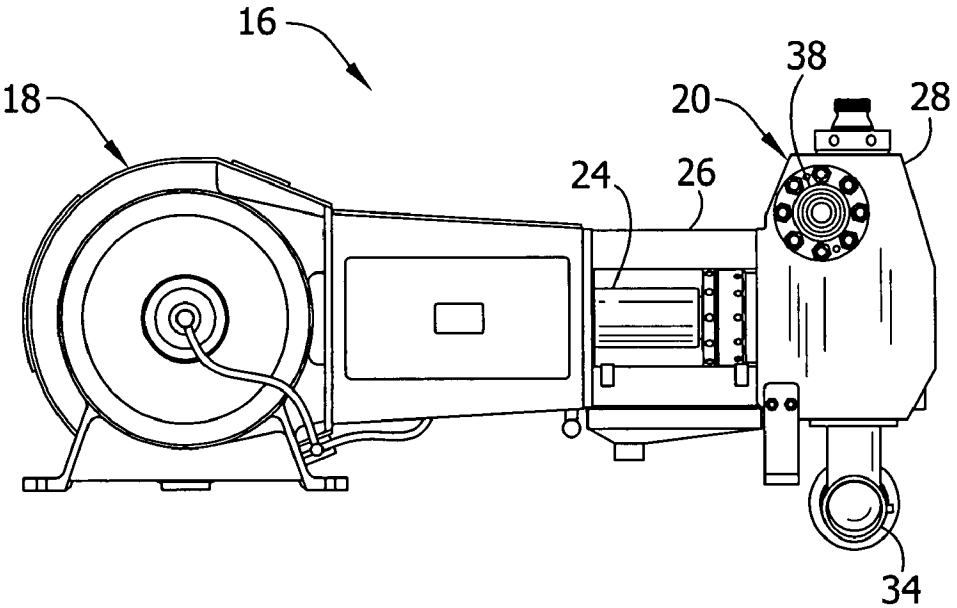

Referring now to the drawings and in particular to FIGS. 1-4, a self-tightening retaining system according to the present invention is indicated in its entirety at 10. The retaining system 10 secures a closure 12 within a bore 14 to close the bore. The system is particularly adapted for holding a plug member in a maintenance access bore of a high pressure reciprocating pump 16. The present description will primarily relate to that application. However, the retaining system may be used in a variety of applications to secure a body in a bore without departing from the scope of the present invention.

The pump 16 is adapted for operation at remote sites and may be placed on a vehicle such as a truck for transportation. The pump includes a first portion known as a "power end," designated generally at 18 (FIG. 1), and a second portion known as a "fluid end," designated generally at 20. The power end 18 includes a gearbox and housing for a crankshaft or eccentric (not shown) for providing power to the fluid end 20 during operation of the pump. A motor, such as a diesel engine (not shown), is in one embodiment external to the power end and operatively connected thereto. The power end 18 is connected to the fluid end 20 by a plurality of fasteners, such as, and for example only, cylinders 24 and tie rods 26 shown in FIGS. 3 and 4.

The fluid end 20 includes a housing 28 through which fluid is moved and its pressure increased. In the embodiment shown in the drawings, the housing 28 contains three or more segregated pump chambers 30 with three or more corresponding reciprocal plungers 32. The pump 16 which is shown is known to those skilled in the art as a "reciprocating triplex" pump, and similarly a pump having five chambers and five plungers (not shown) is known in the art as a "reciprocating quintuplex" pump. An intake pipe 34 beneath the housing 28 is for receiving fluid from a source of fluid (not shown) and dividing it among three branches 36 for delivery to the three chambers. Two lateral outlet ports 38 are for discharging fluid and are adapted for connection to pipes (not shown) for delivery to a destination, such as a well. A gage measurement port 40 is positioned above the housing 28 for attachment of a pressure transducer and is in communication with at least one of the chambers 30 for measuring its pressure. Other types and arrangements of pumps do not depart from the scope of this invention.

Figure 4:
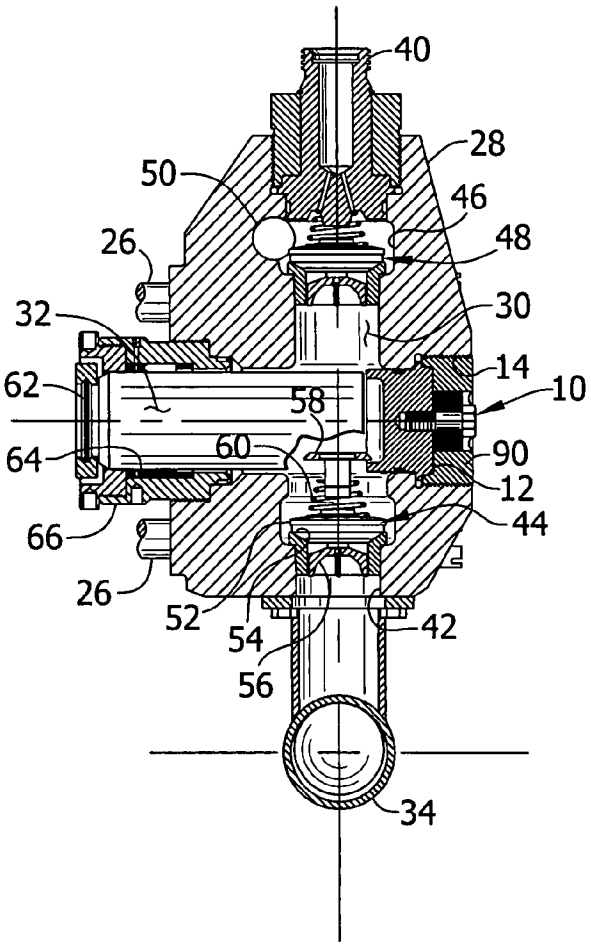
FIG. 4 is a section along line 4-4 of FIG. 3.
Figure 3:
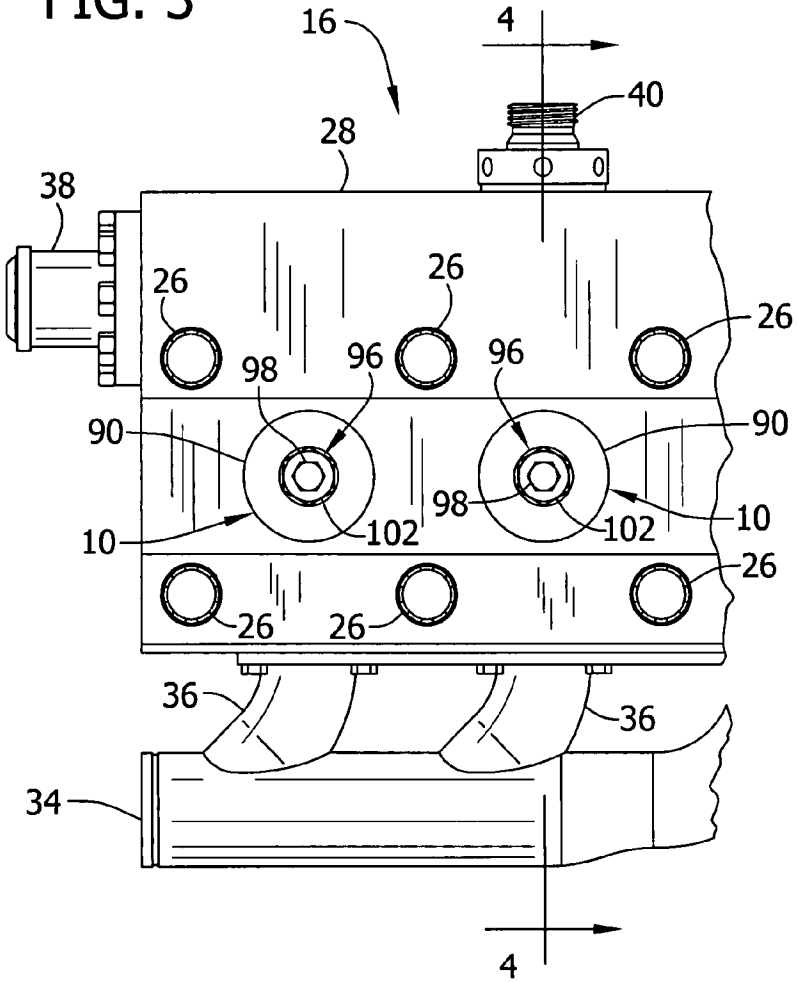
FIG. 3 is an enlarged fragment of FIG. 2.

Referring to FIG. 4, each pump chamber 30 includes a lower intake port 42 with a first one-way flow valve 44 and an upper discharge port 46 including a second one-way flow valve 48. The intake port 42 communicates with a branch 36 of the intake pipe 34 for receiving fluid, and the discharge port 46 communicates through a horizontal passageway 50 with the outlet ports 38 for discharging fluid. The valves 44, 48 are positioned in a vertical relative arrangement, known to those skilled in the art as a "valve over valve" construction. Each valve is conventional and includes a movable valve member 52 engageable with a tapered seat 54 when the valve is closed to prevent flow of fluid in a reverse (i.e., downward) direction. When fluid flows in the forward (i.e., upward) direction, the valve opens with the valve member 52 disengaging from the seat 54 to permit flow through the valve. Each valve also has guide legs 56, a stop 58 for limiting a range of travel of the valve member, and a tapered spring 60 positioned between the stop and valve member. Other valve arrangements and configurations of the fluid end do not depart from the scope of this invention.

The plunger 32 is cylindric in shape and reciprocates horizontally in the pump chamber 30. A coupling 62 is provided to connect the plunger 32 to one of the cylinders 24 which reciprocates and is driven by the crankshaft in the power end 18 of the pump. One or more seals 64 are positioned circumferentially around the plunger 32 to prevent leakage from the chamber, the seals being held in place by a housing 66 (FIG. 4) known to those skilled in the art as a "stuffing box." When the plunger 32 moves toward the power end 18 (toward the left in FIG. 4), a vacuum pressure is formed in the chamber 30. The first one-way flow valve 44 moves to an open position and fluid is received into the chamber from the intake port 42. However, the second one-way flow valve 48 remains closed so that no fluid passes through the discharge port 46. When the plunger 32 strokes back toward the fluid end 20 (toward the right in FIG. 4), pressure in the chamber is elevated causing the first one-way flow valve 44 to close and the second one-way flow valve 48 to open. Fluid flows out the discharge port 46 to the passageway 50 for delivery to the outlet ports 38.

As the operation of the pump 16 is conventional, it will not be described in further detail.

Figure 5:
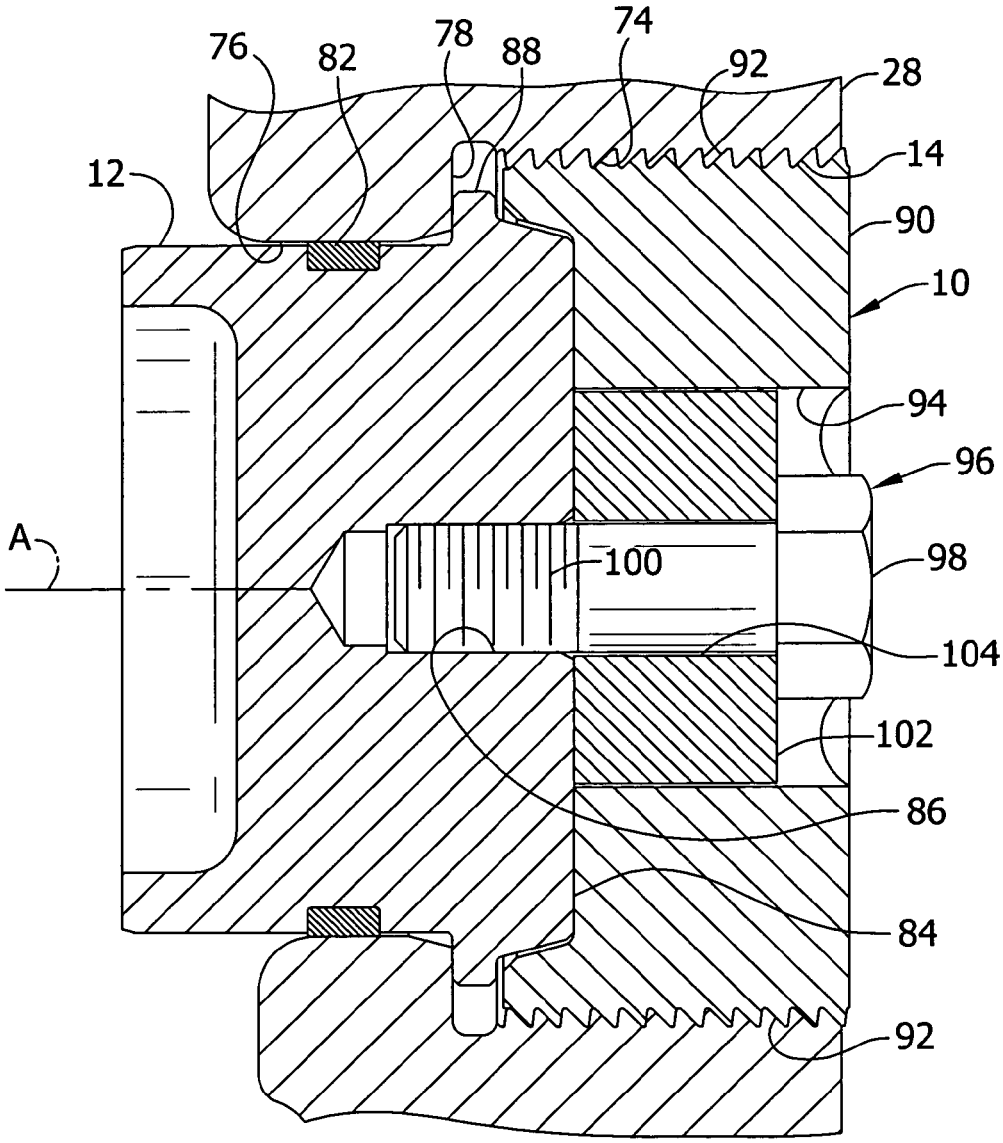
FIG. 5 is an enlarged fragment of FIG. 4.

The housing 28 of the fluid end includes an access port, defined by the bore 14, for each chamber 30 to facilitate maintenance actions on the fluid end 20. Specifically, the access port is located near the one-way valves 44, 48 so that maintenance personnel can reach the valves to replace worn components. The access port bore 14 includes a threaded, outer portion 74 and a smooth (non-threaded), inner portion 76, as shown in FIG. 5. In the embodiment shown in the drawings, the outer portion 74 is axially aligned with the inner portion 76 and has a somewhat larger diameter. The inner and outer portions, as can be seen, are formed from a single unitary portion of the housing 28. A shoulder 78 is formed in the bore 14 (FIG. 5) at the transition between the outer portion and the inner portion. The closure 12 comprises a plug member having a size and cylindrical shape corresponding with the inner portion 76 of the bore 14 for being received in the inner portion to an installed position for closing the pump chamber 30. The closure 12 is at times referred to by those skilled in the art as a "suction valve cover". A circumferential seal 82 is received in a groove around the closure 12 for sealing engagement against the surface of the inner portion 76 of the bore to prevent leakage of fluid through the access port when the closure is at its installed position. The closure 12 has an outer face 84 having a threaded hole 86 in its center which extends into the closure but does not extend completely through the closure. An annular ridge or flange 88 extending around the closure 12 is adapted to contact the shoulder 78 of the bore when the closure is at its installed position as shown in FIG. 5.

A retaining cover 90 (broadly, a "retainer") has a size and shape corresponding with the outer portion 74 of the bore 14 and is received in the outer portion for holding the closure at its installed position. The cover 90 has external threads 92 which are interengageable with the threads of the outer portion 74 of the bore. The cover 90 is rotatable relative to the housing 28 about a central axis A in a tightening direction toward the closure 12 and into the housing, and in a loosening direction away from the closure and out from the housing. When positioned in the bore 14, the cover 90 obstructs removal of the closure 12 from the bore. A central opening 94 extends through the cover 90 and defines an internal wall. In one embodiment, the central opening 94 has a polygonal (e.g., hexagonal) shape.

Figure 6:
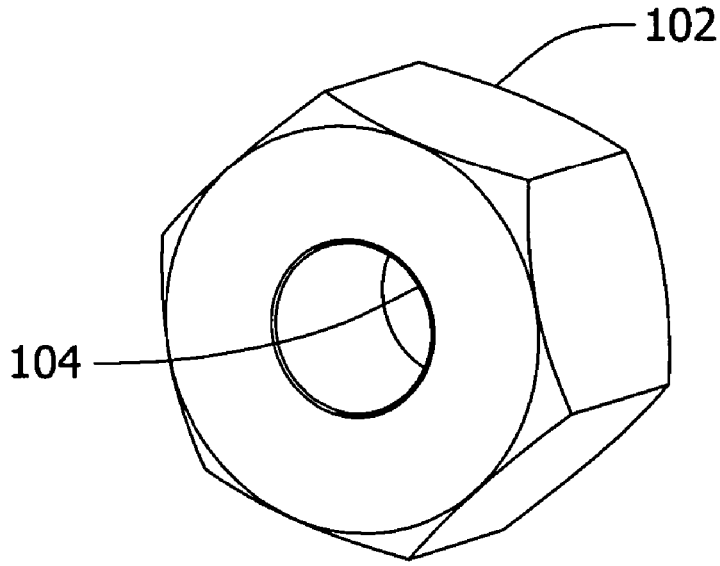
FIG. 6 is a perspective of a locking nut of the invention.
Figure 7:
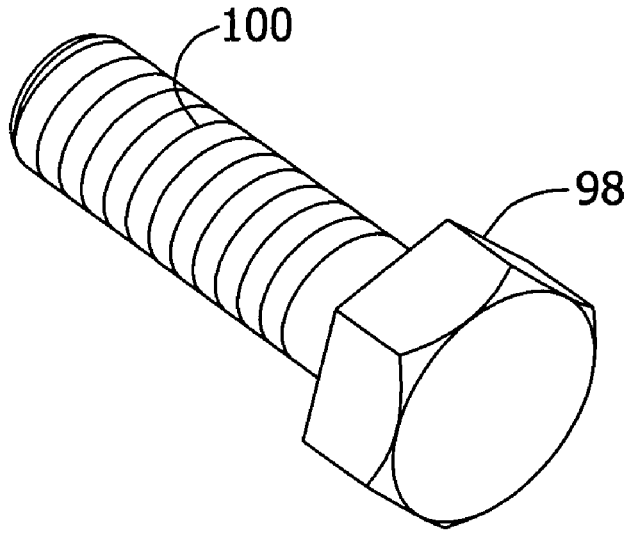
FIG. 7 is a perspective of a left-hand threaded bolt of the invention.

A locking device designated generally at 96 is provided for preventing inadvertent rotation of the cover 90. The locking device 96 comprises a fastener 98 which is secured to the cover 90 so that it rotates along with the cover, and which is received in the threaded hole 86 of the outer face 84 of the closure. In one embodiment, the fastener 98 is aligned with the central axis A when secured to the cover. The fastener 98 illustrated in FIGS. 5 and 7 comprises a bolt having external threads 100 interengageable with threads of the hole 86. For securing the fastener 98 to the cover 90, the locking device 96 further comprises a locking member 102 receivable in the central opening 94 of the cover. In one embodiment (FIG. 6), the locking member 102 is in the form of a nut having a polygonal (e.g., hexagonal) outer surface for nesting engagement with the internal wall of the cover 90 and a clearance bore 104 for receiving the bolt 98 having a circular inner surface. Thus, as described above and shown in the figures, the locking member has an outer surface which forms a radial abutment (1) to the internal wall of the cover and (2) against a rotation of the cover relative to said locking device. Thus, when the locking member is in nested engagement with the cover, the locking member and cover cannot be rotated in opposite radial directions at the same time. The bolt 98 is inserted through the bore 104 of the nut and threaded into the hole 86 of the closure 12. The bolt 98 is tightened to a suitable torque such that the head of the bolt applies substantial force against the nut 102 and, consequently, the bolt 98 and nut 102 are firmly secured together and rotate together with the cover 90. The locking device 96 is compatible with existing pump equipment. Although the locking device of the illustrated embodiment has two parts, it is understood that the locking device may have more or fewer parts without departing from the scope of this invention.

Significantly, the threads 92 of the cover 90 and the threads 100 of the fastener 98 are spiraled in opposite directions. In one embodiment, the cover 90 and its corresponding outer portion 74 of the access port are right-hand threaded, while the fastener 98 and its corresponding threaded hole 86 are left-hand threaded. Therefore, the loosening direction for the cover 90 is typically a counter-clockwise rotational direction. In contrast, when the bolt 98 is rotated in a counter-clockwise direction, it tightens in the hole 86 of the closure. The form of threads 92, 100 is conventional and of a suitable standardized type and pitch. It is understood that the cover may be left-hand threaded with the fastener being right-hand threaded without departing from the scope of this invention.

In operation, the pump 16 may generate vibrations when operating at high power settings which tend to loosen the cover 90 in its threaded engagement with the access port bore 14. If the cover begins to rotate in the loosening direction, the locking device 96 stops it. The nut 102 and bolt 98 rotate about the axis A along with the cover. The rotation of the cover 90 and its right-hand threads 92 cause the cover to begin to loosen in the bore 14, but the left-hand threads 100 of the bolt 98 simultaneously cause the bolt to tighten in the hole 86 of the closure. The tendency of the cover 90 to loosen has insufficient torque to overcome the opposing torque provided by the threads 100 tightening in the hole 86, thereby stopping the rotation of the cover. The closure 12 does not begin to rotate along with the cover relative to the housing 28 due to friction between the closure and the bore 14 and due to the mass of the closure. Frictional force acts between the flange 88 and shoulder 78 and along the outer surface of the closure seal 82. Consequently, the need to shut down the pump 16 due to a loosening cover is precluded.

Figure 9:
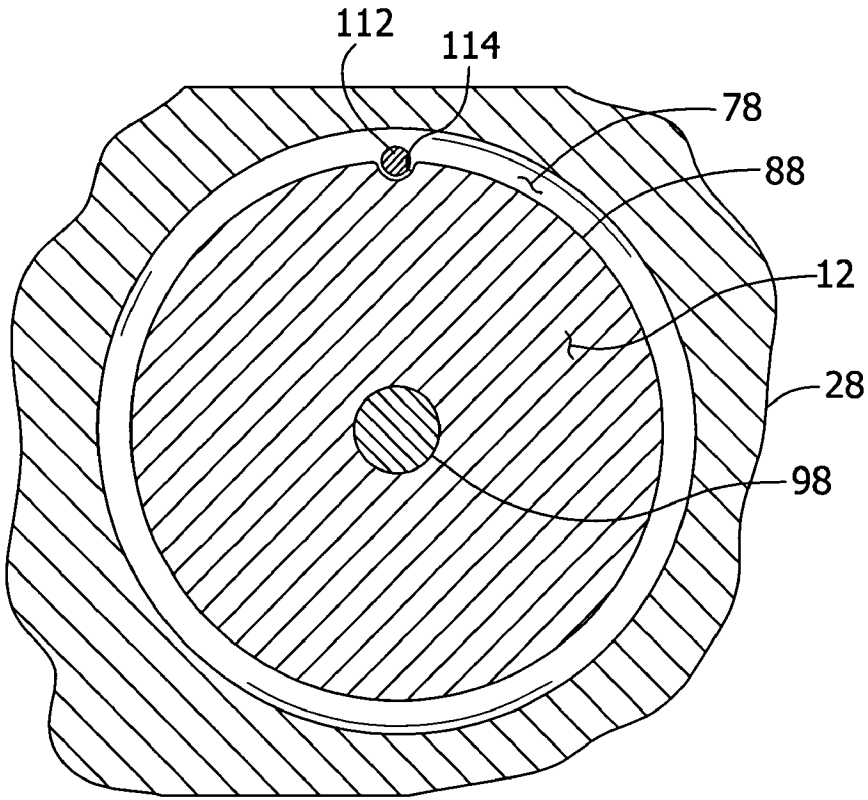
FIG. 9 is a view along line 9-9 of the second embodiment of FIG. 8.
Figure 8:
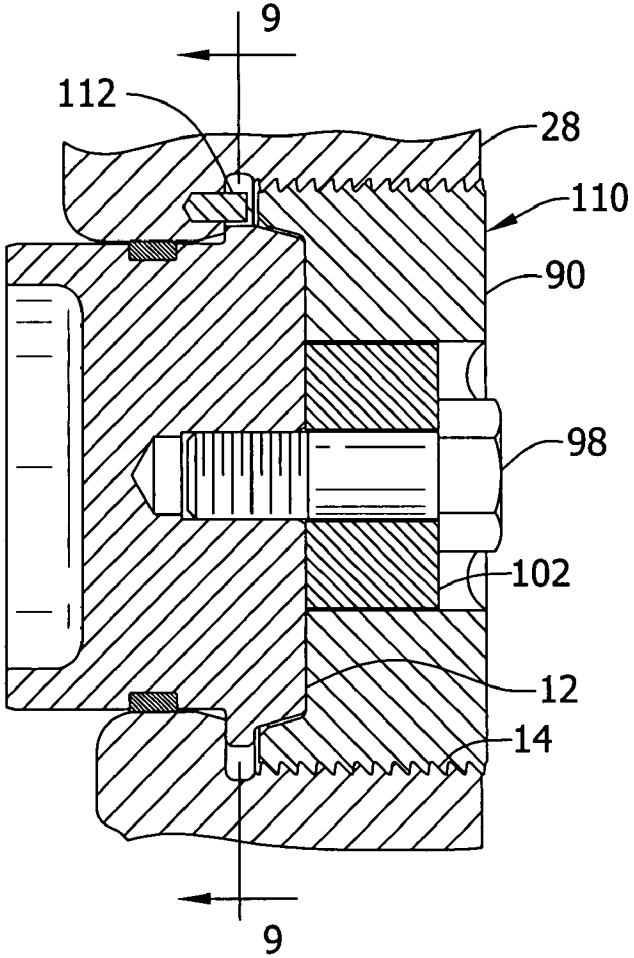
FIG. 8 is a section similar to FIG. 5 but showing a second embodiment of the invention.

A second embodiment 110 of the invention is shown in FIGS. 8 and 9. The retaining system of the second embodiment 110 includes a stop 112 for preventing any rotation of the closure 12 relative to the housing 28. The stop 112 comprises a pin positioned on the shoulder 78 of the bore and received in a hole which is drilled into the housing at the shoulder. The flange 88 of the closure has at least one notch 114 which is aligned with the pin 112. If the torque applied to the closure 12 begins to rotate the closure, the wall of the notch 114 engages the pin 112 and further rotation of the closure is prevented. Other stop configurations do not depart from the scope of this invention. For example, a stop may comprise a fastener (not shown) inside the pump chamber which connects the closure 12 to another part of the pump, such as the valve stop 58, to prevent rotation of the closure.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A self-tightening retaining system for securing a closure at an installed position within a bore, said bore in a portion of a housing, said closure in said installed position closes the bore, said bore having screw threads along at least a portion of the bore and said closure having an internally threaded hole extending into the closure, the system comprising:

a retaining cover for obstructing removal of said closure from said bore, the cover being receivable in the bore in a position generally adjacent the closure and having external threads interengageable with said screw threads of the bore such that the cover is rotatable relative to the housing in a tightening direction for movement of the cover into the bore toward the closure and rotatable in an opposite, loosening direction for movement of the cover out from the bore away from the closure, the cover having a central axis of rotation; and a locking device configured for being secured to the cover, said locking device has an outer surface which forms a radial abutment to said cover, and against rotation of said cover relative to said locking device the locking device comprising a fastener receivable in said hole of the closure and having external threads interengageable with threads of the hole;

wherein the threads of the cover and the threads of the fastener are spiraled in opposite directions such that when the cover rotates in the loosening direction, the fastener becomes tightened in the hole of the closure thereby stopping the rotation.

2. A self-tightening retaining system as set forth in claim 1 wherein the cover has right-hand threads and the fastener has left-hand threads.

3. A self-tightening retaining system as set forth in claim 1 wherein said housing is a pump housing and said retaining cover is a pump access port cover.

4. A self-tightening retaining system as set forth in claim 1 further comprising a central opening extending through the cover defining said internal wall along the opening.

5. A self-tightening retaining system for securing a closure at an installed position within a bore of a housing to close the bore, said bore having screw threads along at least a portion of the bore and said closure having an internally threaded hole extending into the closure, the system comprising:

a retaining cover for obstructing removal of said closure from said bore, the cover being receivable in the bore in a position generally adjacent the closure and having external threads interengageable with said screw threads of the bore such that the cover is rotatable relative to the housing in a tightening direction for movement of the cover into the bore toward the closure and rotatable in an opposite, loosening direction for movement of the cover out from the bore away from the closure, the cover having a central axis or rotation; and a locking device configured for being secured to the covers such that the locking device rotates together with the cover about said central axis, the locking device comprising a fastener receivable in said hole of the closure and having external threads interengageable with threads of the hole;

wherein the threads of the cover and the threads of the fastener are spiraled in opposite directions such that when the cover rotates in the loosening direction, the fastener becomes tightened in the hole of the closure thereby stopping the rotation wherein the locking device further comprises a locking member receivable in said central opening of the cover, the locking member having a size and shape configured to form a radial abutment to an internal wall of the cover and against rotation of the cover relative to said locking device.

6. A self-tightening retaining system set forth in claim 5 wherein the locking member has a polygonal shape.

7. A self-tightening retaining system as set forth in claim 6 wherein the locking member comprises a nut.

8. A self-tightening retaining system set forth in claim 7 wherein said fastener comprises a threaded bolt extending through the nut.

9. A self-tightening retaining system as set forth in claim 8 wherein the bolt is aligned with said central axis of rotation of the cover.

10. A self-tightening retaining system as set forth in claim 1 in combination with the closure.

11. A self-tightening retaining system as set forth claim 10 wherein the closure comprises a plug having a circumferential seal engageable with the bore to close the bore.

12. A self-tightening retaining system as set forth in claim 11 wherein the bore of the housing has an internal shoulder and the closure further comprises an annular flange which engages the shoulder when the closure is at said installed position.

13. A self-tightening retaining system as set forth in claim 12 further comprising a stop for preventing rotation of the closure relative to the housing.

14. A self-tightening retaining system as set forth in claim 13 wherein the flange on the closure has at least one notch therein and when the closure is at said installed position, the stop is received in the notch.

15. A method of locking a closure at a sealing position within a bore of a pump housing, the method comprising the steps of:

installing a retaining cover in said bore adjacent said closure, the cover having screw threads interengageable with screw threads of the bore such that the cover is rotatable relative to the housing in a tightening direction and an opposite, loosening direction, the cover having a central axis of rotation, said step of installing comprising rotating the cover about said axis in said tightening direction;

securing a locking device to the cover such that the locking device and cover cannot be rotated in opposite directions about said central axis at the same time and providing the locking device with a radial abutment to an internal wall of the cover and against rotation of the cover relative to said locking device;

and threading a fastener into a threaded hole in the closure to secure the fastener to the closure, the fastener and hole of the closure having screw threads spiraled in opposite direction to the screw threads of the cover and bore such that when the cover rotates in the loosening direction, the fastener becomes tightened in the hole of the closure thereby stopping the rotation.

* * * * *